US006415887B1

(12) United States Patent
Moran et al.

(10) Patent No.: US 6,415,887 B1
(45) Date of Patent: Jul. 9, 2002

(54) REFRACTIVE WAVE MUFFLER

(75) Inventors: Clay Moran, deceased, late of San Juan Capistrano, by Judy Rhode, executrix; Rodney Lee Asher, San Clemente, both of CA (US)

(73) Assignee: CR Patents, Inc., San Clemente, CA (US)

( * ) Notice: Subject to any disclaimer, the term of this patent is extended or adjusted under 35 U.S.C. 154(b) by 94 days.

(21) Appl. No.: 09/713,575

(22) Filed: Nov. 14, 2000

Related U.S. Application Data

(63) Continuation-in-part of application No. 09/449,767, filed on Nov. 26, 1999, now abandoned.

(51) Int. Cl.[7] ..... F01N 1/08

(52) U.S. Cl. ..... 181/264; 181/224; 181/267

(58) Field of Search ..... 181/264, 267, 181/269, 270, 279, 281, 282, 224, 227, 228, 247, 248; 138/40–46

(56) References Cited

U.S. PATENT DOCUMENTS

| | | | | |
|---|---|---|---|---|
| 2,473,103 A | | 6/1949 | Lathers | |
| 2,708,006 A | | 5/1955 | Backman | |
| 3,999,624 A | | 12/1976 | Treftc et al. | |
| 4,167,986 A | | 9/1979 | Conway | |
| 4,244,441 A | | 1/1981 | Tolman | |
| 4,282,950 A | | 8/1981 | Fuchs | |
| RE31,275 E | | 6/1983 | Wirt | |
| 4,909,034 A | * | 3/1990 | Kakuta | 60/316 |
| 5,165,231 A | | 11/1992 | Rich | |
| 5,200,582 A | | 4/1993 | Kraai, Jr. et al. | |
| 5,214,254 A | | 5/1993 | Sheehan | |
| 5,248,859 A | | 9/1993 | Borla | |
| 5,659,158 A | * | 8/1997 | Browning et al. | 181/265 |
| 5,661,272 A | * | 8/1997 | Iannetti | 181/252 |
| 6,035,964 A | | 3/2000 | Lange | |

FOREIGN PATENT DOCUMENTS

JP 06017636 A * 1/1994 ..... F01N/1/00

* cited by examiner

*Primary Examiner*—Robert E. Nappi
*Assistant Examiner*—Edgardo San Martin
(74) *Attorney, Agent, or Firm*—Gene Scott-Patent Law & Venture Group

(57) ABSTRACT

Within an exhaust duct are positioned a plurality of concentrically arranged, open ended, right cylinders supported axially within the exhaust duct, wherein each of the cylinders includes an inlet end and an exit end. The inlet ends are positioned in sequential downstream order from the outermost of the cylinders to the innermost of the cylinders. The cylinders are graduated in length sequentially with the outermost cylinder being shortest in length and the innermost cylinder being longest in length. The inlet ends of each of the cylinders provide a circular leading edge with a sawtooth conformation. An elongated smooth rod is positioned on the longitudinal axis of the exhaust duct with a downstream end of the rod providing a flared portion positioned at the mouth of the innermost of the cylinders. A plurality of radially directed flow directing vanes are engaged along thier outer edge with an inside surface of the exhaust duct and also along an inside edge with each of the cylinders and the rod for securing them in place within the exhaust duct. These flow directing vanes extend upstream of the outermost of the cylinders and downstream of the innermost of the cylinders.

8 Claims, 2 Drawing Sheets

REFRACTIVE WAVE MUFFLER

The present application is a continuation-in-part application under 37 C.F.R., Section 1.60, of a prior filed utility patent application having Ser. No. 09/449,767 and an official filing date of Nov. 26, 1999, now abandoned and which, in part, discloses substantially the same material as described herein.

BACKGROUND OF THE INVENTION

1. Field of the Invention

This invention relates generally to an exhaust muffler and more particularly to such a muffler with baffle for reducing sound output without significant increase in back-pressure developed within the muffler.

2. Description of the Related Art

Exhaust gas flow from an internal combustion engine is made up of a train of high pressure zones interspersed with low pressure zones as the exhaust valves of the engine open and close. The zone train moves through an exhaust pipe to atmosphere. The size of the exhaust pipe is important because it must be small enough to keep the high pressure zones from expanding too rapidly in order to retain thermal and kinetic energy, and it must be large enough to not restrict gas flow which would cause excessive back-pressure. When the exhaust pipe is properly designed, the low pressure zones in the exhaust gas exert a drawing action on the combustion chamber which helps to purge expended gas from the chamber. Mufflers attenuate sound by gradually dissipating the latent energy remaining in the exhaust gas but this also tends to reduce the drawing action by building back-pressure. The exhaust gases have a range of longitudinally propagated sound frequencies (waves) due to the high state of molecular motion within the gases as they are expelled from the combustion chamber. Some of these sound frequencies can support or assist expulsion of the exhaust gases while other frequencies will not. Attenuating all sound, as in a conventional muffler, reduces power because of loss of the potentially supportive sound frequencies. Neutralizing reverse waves, i.e., those traveling upstream within the exhaust pipe is important for reducing power loss. Thus, anti-reversing exhaust system designs exist in the art, and these attempt to cancel substantial amounts of echoing and reverse wave propagation. Tuning an exhaust system is considered to be a complex process of sizing exhaust tubes, determining the length of components and possibly combining multiple tubes to synchronize gas pulses with sound waves for the lowest power loss within a selected RPM range for a given engine. The present invention provides a novel approach to sound attenuation by canceling reverse waves so as to achieve least power loss and maximum engine power. It attenuates noise by focusing sound waves, nullifying unwanted frequencies while amplifying reciprocal waves in conjunction with exhaust gas pulses to reinforce exhaust gas exit flow and maximize the scavenging effect in the combustion chamber to increase power.

The following art defines the present state of this field:

Wirt, U.S. Pat. No. Re. 31,275 describes a broadband sound attenuating, acoustically lined, duct of varying cross-sectional shape but in the usual case having a constant cross-sectional area, and wherein the duct liner is configured to maintain an essentially constant acoustic existence and scaled acoustic reactance throughout provided by means of changes in the effective depth of the liner. Design tradeoffs permit some variation in the cross-sectional area of the duct with concomitant changes in liner properties. In all cases, the duct is designed so that every section along its major axis is optimally tuned to absorb most efficiently some part of the frequency spectrum of interest. The device is particularly suitable for sound suppression of jet aircraft engines.

Emmons, U.S. Pat. No. 1,400,350 describes a muffler, including a body portions, inlet and exhaust pipes connected to said body portion, a plate positioned adjacent the inlet end of the muffler, and provided with a centrally disposed cone shaped projection extending toward and in alignment with the inlet pipe, and adapted to deflect gases radially outward, said plate being formed with radially disposed curved slots, and vanes attached to said plate adjacent each of said slots or imparting a whirling motion to fluid passing through said slots.

Lathers, U.S. Pat. No. 2,473,103 describes a muffler comprising a tubular casing having inlet and outlet openings at opposite ends thereof and adapted to receive through its inlet opening the exhaust gases from an internal combustion engine or the like, said casing including a first section the inner wall of which gradually diverges from the inlet end of the casing toward the outlet end of said casing to form a substantially conical first section; and imperforate, elongated member of substantially conical configuration within said first section having its apex disposed adjacent the inlet opening of said casing and its base extending beyond the large end of said first section; an imperforate, elongated member of substantially conical configuration within said first section having its apex disposed adjacent the inlet opening of said casting and its base extending beyond the large end of said first section; a second section adapted to receive the exhaust gases from the first section and being of bulbous or barrel-shaped configuration, said section enclosing the base portion of said conical member and having a maximum diameter greater than the maximum diameter of said conical section and a minimum diameter corresponding substantially to the maximum diameter of said first section, the outer surface of said conical member being spaced from the inner surfaces of said first and second sections to provide therebetween a flow path of constantly increasing area for the exhaust gases as they pass through said sections; a spiral vane positioned between said spaced surfaces to impart a spiral movement to the exhaust gases as they pass through said flow path; a third section having a baffle therein, said baffle including two substantially flat perforated plates arranged in parallel spaced relation and extending longitudinally throughout substantially the length of said section, and at least two other substantially flat perforated plates arranged in parallel spaced relation and being coextensive with the first mentioned plates, said first mentioned plates and said second mentioned plates being disposed in cross-like or honeycomb formation within said third section; and a fourth section having a baffle secured therein, said baffle extending longitudinally throughout substantially the length of said third section and having two perforated portions arranged in a V formation with the apex of the V directed toward the inlet of the fourth section and the total area of the perforations in said V formation being greater than the total area of the perforation in the baffle in said third section.

Backman, U.S. Pat. No. 2,708,006 describes a muffler for silencing the exhaust of an internal combustion engine, said muffler comprising; intercommunicating inlet intermediate and outlet sections disposed in axially aligned series relationship, each of said sections comprising a hollow cylindrical casing portion for confining exhaust gases within said muffler; said inlet section comprising an upstream-wardly disposed portion adapted for connection to the exhaust duct of an internal combustion engine; an insert element disposed within said casing portion of said inlet section and including a plurality of radially inwardly extending webs each provided at its radially outwardly disposed end portion with an axially upstreamwardly directed extension, said webs being arranged to cause effective uniform distribution of exhaust gases flowing toward said intermediate section; a plurality of coaxially nested tubular member disposed in laterally spaced relationship within said casing portion of said intermediate section each of said tubular member which is located intermediate said intermediate section casting portion and the innermost of said tubular members being formed of perforated sheet metal; a plurality of spaced substantially uniformly peripherally disposed spacing member formed of perforated sheet metal and interconnecting said intermediate section casing portion and adjacent ones of said tubular members for maintaining said tubular members and said casing portion in said spaced coaxial relationship, said spacing members being axially coextensive with said tubular members and defining with said tubular members and said casing portion a plurality of longitudinally extending gas passages extending through said intermediate section; and a plurality of slightly helically disposed partition members comprised within said outlet section and defining with the casing portion thereof a plurality of gas passages communicating with said gas passages of said intermediate section and with the atmosphere Trefte, et al., U.S. Pat. No. 3,999,624 describes a pneumatic muffler providing within the cavity formed by its conical-like shell a proportionate expansion chamber in immediate communication with an exhaust port and an integrally related quiescent chamber reducing in volume for cushioning the introduced volume of exhaust so as to convert the same into a passive modulated acoustical pressure wave, which is then exhausted into the ambient atmosphere.

Conway, U.S. Pat. No. 4,167,986 describes a modular fluid stream silencing apparatus, primarily for use in air conditioning ducts and the like, comprising a plurality of air splitters formed of acoustical energy absorbing material, the air splitters being of such sizes that the plurality of air splitters can be installed within a duct centrally of the duct and coextensive with one another, additional air splitters which can be added to increase the size of the silencing apparatus for larger ducts, and a plurality of rods passing through the duct and the air splitters for mounting the air splitters, the preferred form of air splitters being annular and of such sizes to be mounted coaxially with one another.

Tolmon, U.S. Pat. No. 4,244,441 describes a broad band acoustic attenuator particularly useful for attenuating gas turbine engine noise utilizes a plurality of axially extending, open-ended, perforated cylinders concentrically arranged within the exhaust duct of the gas turbine engine for attenuating noise therefrom without imposing significant back pressure penalties.

Fuchs, U.S. Pat. No. 4,282,950 describes a silencer or muffler for internal combustion engines, particularly for two-stroke or cycle internal combustion engines, comprising at its inlet an essentially frustoconical diffuser, a shell of a truncated cone immediately adjoining with its end having the greater diameter the end of the diffuser having the greater diameter, and deflector for the gas stream downstream of said shell of a truncated cone.

Rich, U.S. Pat. No. 5,165,231 describes an anti-reversion exhaust system including an exhaust pipe and shroud attached to the exhaust pipe. The exhaust pipe and shroud cooperate to induce intersecting, generally opposed gaseous flows to effectively prevent reversionary flow in the direction of an associated internal combustion engine.

Kraai, Jr., et al., U.S. Pat. No. 5,200,582 describes sound attenuating mufflers, and more particularly sound attenuating mufflers for dampening sound waves of various frequencies above a pre-selected cut-off frequency. Specially positioned acoustical insulation is provided to partially attenuate sound waves of a relatively low frequency. The insulation is carried in a chamber having one dimension of sound wave travel on the order of one-tenth the wavelength of a preselected cutoff frequency above which sound attenuation is desired. An adjacent chamber substantially free of insulation has one dimension of sound wave travel on the order of one-quarter wavelength of the cutoff frequency.

Sheehan, U.S. Pat. No. 5,214,254 describes a triple cone exhaust wave and flow tuner for controlling the flow of exhaust gases and altering the resonant wave frequency generated by thee exhaust pulses including a reverse cone megaphone shaped enclosure, a perforated guide sleeve, and a rotatable, slidable perforated tuning pipe having a conical end.

Boria, U.S. Pat. No. 5,248,859 describes an exhaust collector for use with an internal combustion engine of the type having a plurality of generally nested exhaust tubes for individually receiving exhaust gases from separate associated engine exhaust ports. The collector is frustoconically shaped and has an open upstream end sealingly engaged with the downstream ends of the exhaust tubes to receive exhaust gases directly therefrom. The collector is oriented with its generally conical shape convergent in the downstream direction, and includes an internal cone shaped stem piece oriented with its longitudinal axis coaxial of the collector. A base portion of the stem piece is nested between and extends from the downstream ends of the exhaust tubes, and an apex end of the stem piece is generally aligned with the collector downstream end. The collector interior wall defines a smooth cylindrical surface when taken in radial cross section at any position along generally the entire length of the axis of the collector downstream of the tube exit ends. Preferably, the upstream end of the collector portion is formed to conform with and securely join to the array of nested exhaust tubes. A muffler/collector combination has an outer muffler casing encircling the collector portion and encasing the same with upstream and downstream end caps. An additional embodiment provides for at least one catalytic exhaust converter positioned and arranged within a corresponding exhaust tube upstream of the collector, in combination with either the collector or the muffler collector combination. Sound absorbing material may be disposed in an interior casing space defined between the inner surface of the outer casing and the outer surface of the nested exhaust tubes and the collector.

Lange, U.S. Pat. No. 6,035,964 describes a combined device for positioning between the outlet of a gas turbine and a steam generator. The combined device acts as a sound-absorber and as a diffuser and is designated a gas turbine muffler. The gas turbine muffler has an inner zone, which widens out in the flow direction S at a relatively large angle. Deflector elements arranged in this inner zone delineate diffuser channels that are located between adjacent deflector elements. The diffuser channels widen out in each case at a significantly smaller acute angle of less than 7 degree. In addition to decelerating the stream of gas and hence, in addition, increasing the pressure, the narrow diffuser channels also bring about sound-absorption by reducing the regions of turbulence, making the stream more uniform, and aligning the stream. As a result of the additional function of the gas turbine muffler as a diffuser, the separate diffusers, which were required previously and which claimed a large amount of construction space, can be dispensed with.

The prior art teaches the use of acoustic baffles and mufflers for engines, but does not teach a very high efficiency baffle as described in this application for attenuating sound while increasing engine power. The present invention fulfills these needs and provides further related advantages as described in the following summary.

SUMMARY OF THE INVENTION

The present invention teaches certain benefits in construction and use which give rise to the objectives described below.

A plurality of concentrically arranged, open ended, right cylinders are supported axially within an exhaust duct, wherein each of the cylinders includes an inlet end and an exit end. The inlet ends are positioned in sequential downstream order from the outermost of the cylinders to the innermost of the cylinders. The cylinders are graduated in length sequentially with the outermost cylinder being shortest in length and the innermost cylinder being longest in length. The inlet ends of each of the cylinders provide a circular leading edge with a sawtooth conformation. An elongated smooth rod is positioned on the longitudinal axis of the exhaust duct with a downstream end of the rod providing a flared portion positioned at the mouth of the innermost of the cylinders. A plurality of radially directed flow directing vanes are engaged along thier outer edge with an inside surface of the exhaust duct and also along an inside edge with each of the cylinders and the rod for securing them in place within the exhaust duct. These flow directing vanes extend upstream of the outermost of the cylinders and downstream of the innermost of the cylinders.

A primary objective of the present invention is to provide an apparatus and method of use of such apparatus that provides advantages not taught by the prior art.

Another objective is to provide such an invention capable of greatly quieting an exhaust pipe or duct.

A further objective is to provide such an invention capable of improving engine power.

A still further objective is to provide such an invention capable of operating with small as well as large engines.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

The above described drawing figures illustrate the invention in at least one of its preferred embodiments, which is further defined in detail in the following description.

Figure 1:
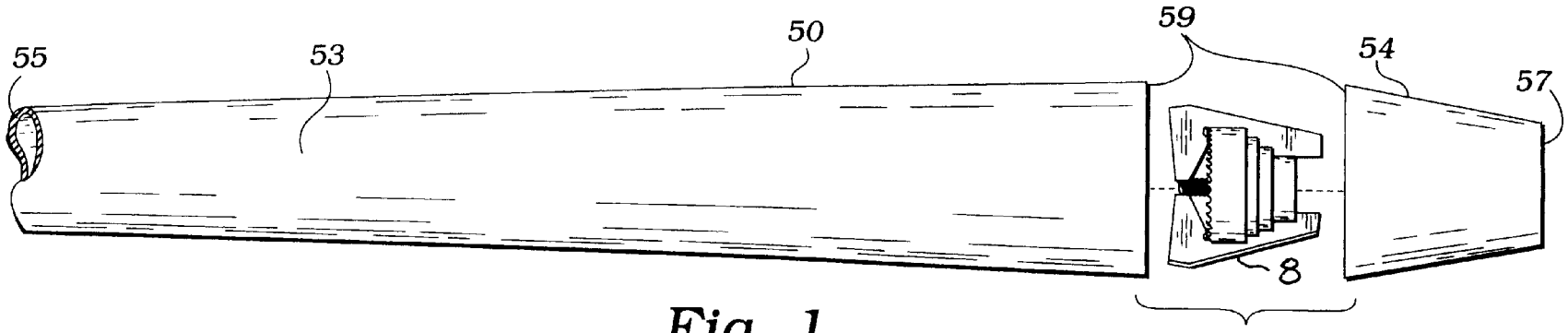
FIG. 1 is a side elevational exploded view of the preferred embodiment of the present invention.

The present invention apparatus comprises an exhaust duct 50, which may alternately be defined as a pipe, a cylinder or a tube, for carrying exhaust gases from a source (not a part of the invention), so as to exhaust the gases. Therefore, the exhaust duct 50 is joined to the source of such gases at an intake end 55 and is open to atmosphere at exhaust end 57. The exhaust duct 50 provides an interior wall surface 52, which expands in diameter as one moves from the intake end 55 toward the exhaust end 57 until reaching an intersection 59 with a terminal portion 54 of the exhaust duct 50, whereupon the interior wall surface 52 contracts in diameter until reaching the exhaust end 57. This shape is clearly shown in FIGS. 1 and 2. The portion of the exhaust duct 50 from the intake end 55 to the intersection 59 is an expansion chamber 53 and the portion of the exhaust duct 50 from the intersection 59 to the exhaust end 57 is a compression chamber because of the shape of these two portions and the effect they have upon the exhaust gases which flow within the exhaust duct 50 from intake to exhaust ends 55, 57.

Figure 2:
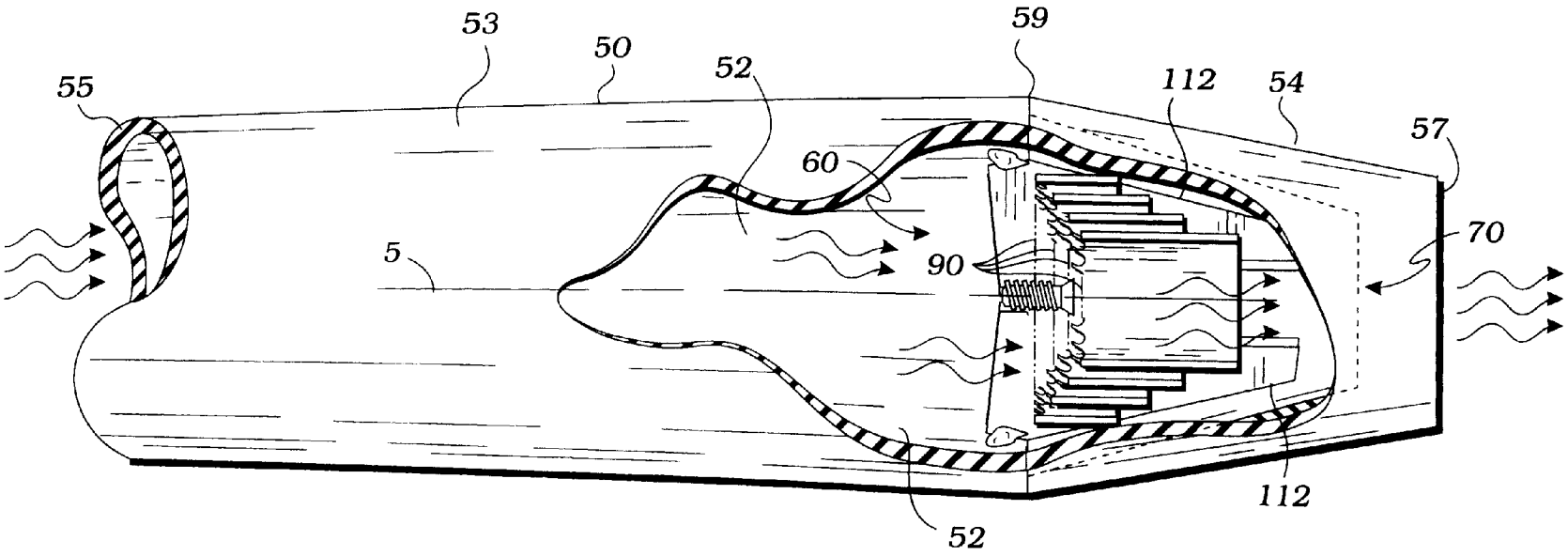
FIG. 2 is a partial cutaway view thereof as assembled.
Figure 3:
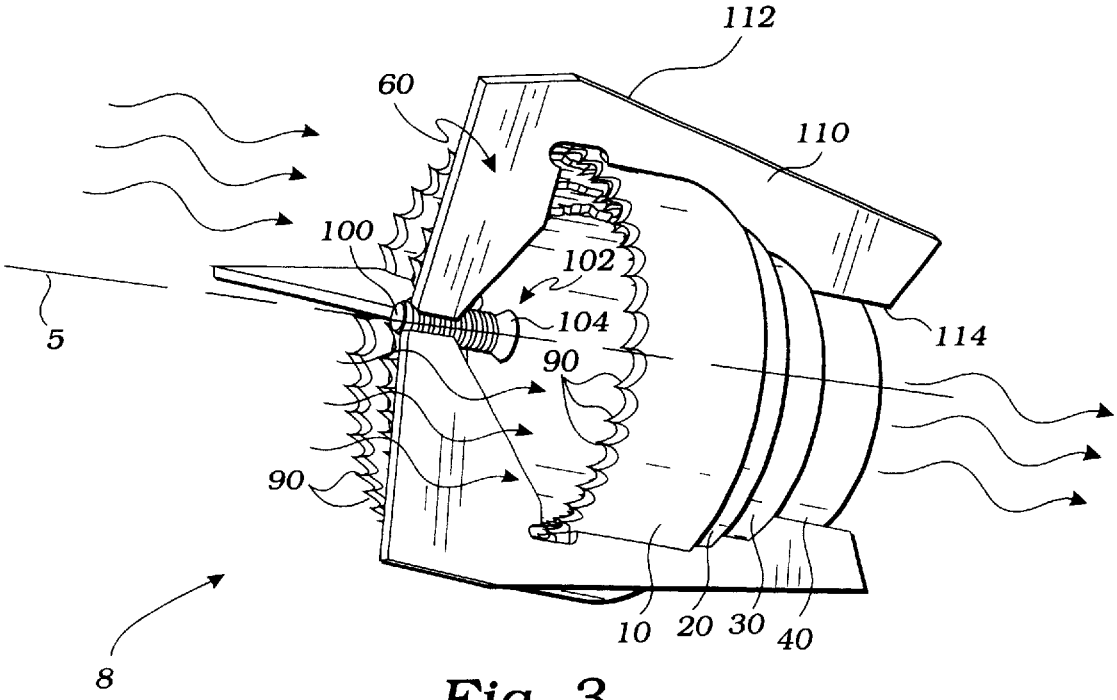
FIGS. 3 and 4 are perspective views of an acoustic baffle thereof.
Figure 4:
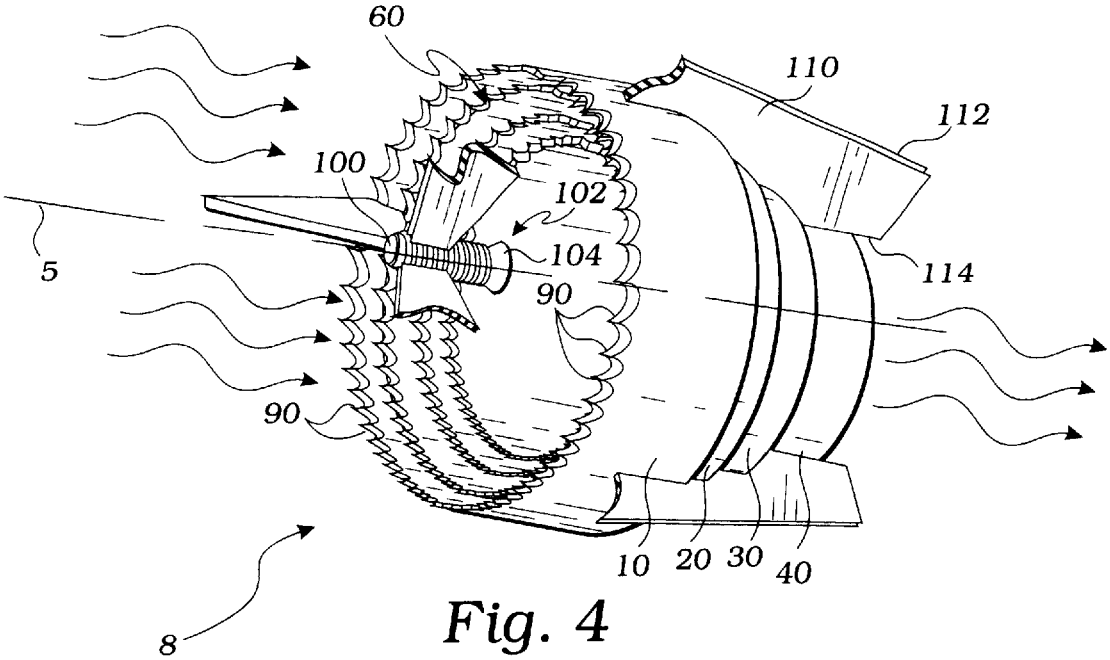

An acoustic-gas lens 8 is mounted within the exhaust duct 50 at the intersection 59 as shown in FIG. 2, and comprises a plurality of, concentrically positioned, open ended right cylinders 10, 20, 30, 40 preferably made of a rigid material such as metal or certain strong plastics, and supported axially within the cylindrical exhaust duct 50, also made of similar materials, wherein each of the cylinders 10–40 include an inlet end 60 and an exit end 70 as is clearly shown in FIG. 2. The inlet ends 60 of the cylinders 10–40 are positioned in sequential downstream order from the outermost of the cylinders 10 to the innermost of the cylinders 40. Also, the cylinders 10–40 are graduated in length sequentially with the outermost cylinder 10 being shortest in length, and the innermost cylinder 40 being longest. The inlet ends 60 of each of the cylinders 10–40 terminates with, and provides a circular leading edge with a sawtooth conformation, i.e., the edges are each cut into a series of teeth 90 which, are directed upstream.

An elongated rod 100 of a rigid material and a diameter that is small relative to the cylinders, is positioned on the longitudinal axis 5 of the exhaust duct 50, which is, of course the axis about which the concentric cylinders 10–40 are mounted. A downstream end 102 of the rod 100 provides a flared portion 104, which is positioned at the inlet 60 of the innermost of the cylinders 40.

A plurality of radially positioned flow directing vanes 110 are each engaged along its outer edge 112 with the inside surface 52 of the exhaust duct 50, and along an inside edge 114 with each one of the cylinders 10–40 and the rod 100 for rigidly securing these elements in place within the exhaust duct 50. The flow directing vanes 110 preferably extend both upstream of the outermost of the cylinders 10 and downstream of the innermost of the cylinders 40.

In operation, with the invention engaged with an internal combustion engine, an exhaust pulse enters the intake end 55 of the exhaust duct 50 and expands and accelerates as the inner wall diameter increases. The exhaust pulse is now larger and has a lower density. Sound energy is amplified as the pulse expands. The acousticgas lens 8 is positioned at the intersection so that the exhaust pulse and its sound waves are compressed by the lens 8 and the terminal portion 54. The configuration and placement of the lens 8 forms an echo free chamber that attenuates edge formed sound waves without altering the focused energy. The saw teeth 90 scatter the highest frequency sound waves, nullifying their energy and preventing them form forming harmonics that could create reversing waves. The curved face of the lens 8 collects slightly longer sound waves and directs them back at incoming sound waves to nullify these frequencies. Certain sound frequencies are not affected by this effect. Gas pulse energy and the lowest frequency sound waves are not affected by the higher frequency effects described above. Both gas pulses and sound waves exhibit common behavior when passing through the lens 8. Resistance from the solid elements slow the sound and gas waves more near the center of the lens 8 due to the longer lengths of the cylinders 10–40. This tends to draw the gas and sound waves into a convergence while allowing gas and sound at the center to move relatively unrestricted. The result is a forced compression of out of phase components of the gas and sound waves and this tends to attenuate medium and long frequencies, reducing sound level while preventing sound and gas wave reverse reflections from arising.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. An acoustic-gas lens apparatus comprising:

a plurality of, concentrically arranged, open ended right cylinders supported axially within an exhaust duct, wherein each of the cylinders includes an inlet end and an exit end, the inlet ends of the cylinders positioned in sequential downstream order from the outermost of the cylinders to the innermost of the cylinders, the cylinders graduated in length sequentially; the outermost cylinder being shortest in length, the innermost cylinder being longest in length;

the inlet ends of each of the cylinders providing a circular leading edge with a sawtooth conformation.

2. The apparatus of claim 1 further comprising an elongated smooth rod positioned on the longitudinal axis of the exhaust duct with a downstream end of the rod providing a flared portion positioned at the mouth of the innermost of the cylinders.

3. The apparatus of claim 2 further comprising a plurality of radially directed flow directing vanes, each of the vanes engaged along an outer edge thereof with an inside surface of the exhaust duct and along an inside edge of the vanes with each of the cylinders and the rod for securing the cylinders and the rod in place within the exhaust duct.

4. The apparatus of claim 3 wherein the flow directing vanes extend upstream of the outermost of the cylinders and further extend downstream of the innermost of the cylinders.

5. A refractive wave muffler apparatus comprising:

an exhaust duct for carrying exhaust gases from an intake end thereof to an exhaust end open to atmosphere;

an interior wall surface of the exhaust duct formed with an ever increasing diameter between the intake end and an intersection with a terminal portion of the exhaust duct, the terminal portion providing an ever decreasing diameter between the intersection and the exhaust end of the exhaust duct;

a plurality of, concentrically arranged, open ended right cylinders supported axially within the exhaust duct, wherein each of the cylinders includes an inlet end and an exit end, the inlet ends of the cylinders positioned in sequential downstream order from the outermost of the cylinders to the innermost of the cylinders, the cylinders graduated in length sequentially; the outermost cylinder being shortest in length, the innermost cylinder being longest in length;

the inlet ends of each of the cylinders providing a circular leading edge with a sawtooth conformation.

6. The apparatus of claim 5 further comprising an elongated smooth rod positioned on the longitudinal axis of the exhaust duct with a downstream end of the rod providing a flared portion positioned at the mouth of the innermost of the cylinders.

7. The apparatus of claim 6 further comprising a plurality of radially directed flow directing vanes, each of the vanes engaged along an outer edge thereof with an inside surface of the exhaust duct and along an inside edge of the vanes with each of the cylinders and the rod for securing the cylinders and the rod in place within the exhaust duct.

8. The apparatus of claim 7 wherein the flow directing vanes extend upstream of the outermost of the cylinders and further extend downstream of the innermost of the cylinders.

* * * * *